United States Patent [19]

Schroder

[11] Patent Number: 5,065,846

[45] Date of Patent: Nov. 19, 1991

[54] ELEVATOR GROUP CONTROL FOR THE IMMEDIATE ASSIGNMENT OF DESTINATION CALLS

[75] Inventor: Joris Schroder, Lucerne, Switzerland

[73] Assignee: Inventio AG, Switzerland

[21] Appl. No.: 464,524

[22] Filed: Jan. 12, 1990

[30] Foreign Application Priority Data

Jan. 19, 1989 [CH] Switzerland ..... 169/89-9

[51] Int. Cl.[5] ..... B66B 1/18

[52] U.S. Cl. ..... 187/127

[58] Field of Search ..... 187/122, 123, 124, 127, 187/129

[56] References Cited

U.S. PATENT DOCUMENTS 3,561,571 2/1971 Gingrich ..... 187/129

4,046,228 9/1977 Powell ..... 187/127

*Primary Examiner*—A. D. Pellinen

*Assistant Examiner*—Lawrence E. Colbert

*Attorney, Agent, or Firm*—Marshall & Melhorn

[57] ABSTRACT

A group control for an elevator system assigns immediately destination calls which were entered at a floor lying behind the car in the direction of travel of the car and for a floor which lies ahead of the car. The group control includes a call memory having a first register for storing the calls of like direction of travel entered ahead of the car, a second register for storing the calls of opposite direction of travel and a third register for storing the calls of like direction of travel entered behind the car. A control circuit is activated each time a call is entered such that a call of the same direction of travel is written, according to its position with respect to the car, into the first or third register. The allocated calls of the third register are transferred into the second register on the first change in direction of travel of the car and into the first register on the second change in direction of travel so that they can be detected by a selector addressing the call memory.

8 Claims, 2 Drawing Sheets

ELEVATOR GROUP CONTROL FOR THE IMMEDIATE ASSIGNMENT OF DESTINATION CALLS

BACKGROUND OF THE INVENTION

The invention relates in general to a group control for elevators and, in particular, to a group control with immediate assignment of calls of destination.

Many known elevator group control systems include call registering devices located at the floors, by means of which calls for desired floors of destination can be entered. The entered calls are stored in floor and car call memories assigned to the elevators of the group where a call characterizing the entry floor is stored in the floor call memory and the calls characterizing the destination floors are stored in the car call register memory. Selectors assigned to each elevator of the group indicate the floor of a possible stop. First and second scanners are assigned to each elevator of the group. The first scanner operates during a cost of operation calculation cycle to store for each floor the costs in a cost memory. The second scanner operates during a cost comparison cycle of the costs for all elevators by means of which the entered call is assigned to the car of the elevator group which exhibits the lowest operating costs.

In such group controls, as for example shown in the European patent no. EP-B 0 032 213, operating costs corresponding to the waiting times of passengers are calculated from data specific to each of the elevators and compared one with the other for the purpose of ascertaining the elevator best able to serve a certain floor. An important factor of the operating costs is due to the car calls which, in controls of that kind, are known only for the instantaneous trip traveled by the car. It therefore appears undesirable to allocate floor calls which are, for example, entered behind the car in the same direction of travel since the operating costs determined in the trip taking place would be wrong for a subsequent trip. Therefore, calls of that kind could at most be fed to a waiting queue, wherein it should be indicated by suitable signaling to the passenger waiting at the floor concerned that his call is not yet allocated and an indefinite waiting time must be accepted. If the waiting queue is already filled with calls which, for example due to overloading, could not be allocated, then correspondingly longer waiting times must be reckoned with.

Another elevator group control is shown in European patent no. EP-A 0 246 395, in which the destination floor can be entered at the entry floor. This control registers a call for the input floor and a call for the destination floor so that, by contrast to the group control described in the previous paragraph, the operating costs of calls of subsequent trip of the car can be ascertained more readily. Since the numbers of boarding passengers and alighting passengers, which are important for the calculation of the operating costs, are merely probable values derived from the experiences of the past, the operating costs, which correspond to the lost times of passengers probably situated in the car when serving a new call, can be ascertained only approximately. When the probable number of passengers in the car is not determinable with sufficient accuracy, no decision can be made with respect to an overload on assignment of a new call. In addition, an assignment of calls for a subsequent trip is not possible when the destination floor entered at a floor lying behind the car in direction of travel lies in front of the car, so that calls of that kind would have to be fed to a waiting queue.

An improvement in the call assignment criteria, particularly with a view of avoidance of overload for a floor to be allocated, is proposed in the European patent application no. EP-PA 88106273.1. It is suggested to replace the probable numbers of boarding and alighting passengers by those actually to be expected. In this case, a sum is formed from the number of the calls entered at a floor and the number of the calls designating this floor as a destination floor and stored as a load value in a load memory, wherein the load value is interpreted in the calculation as the number of passengers which would be situated in the car on the departure from the floor concerned.

SUMMARY OF THE INVENTION

The present invention is based on the task of improving an elevator group control in such a manner that destination floor calls in the same direction of travel as the car and entered at a floor behind the car can be assigned immediately after the call entry and do not have to be fed to a waiting queue. The group control according to the present invention includes a call memory having a first register for storing the calls entered ahead of and in the direction of travel of the car, a second register for storing the calls in the opposite direction of travel and a third register for storing the calls entered behind and in the direction of travel of the car, wherein only the assigned calls in the first register are detected by a selector. A control circuit, which is connected to the call memory and a load memory, is activated by each entry of a call in such a manner that a call in the same direction of travel as the car is entered into the first or third register according to the position of the car with respect to the floor where the call was entered. For the purpose of correcting the load values, only those memory cells of the load memory are enabled each time which are associated with the destination calls entered either ahead or behind the car. The control circuit also enables the assigned calls in the third register to be transferred into the second register on the first change in direction of travel and into the first register on the second change in direction of travel of the car.

The advantages attained by the present invention are particularly evident in the increased capacity for accepting calls. Due to the immediate assignment of destination calls in the like direction of travel entered behind the car, it is not necessary even in the case of heavy traffic to feed new calls to a waiting queue.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
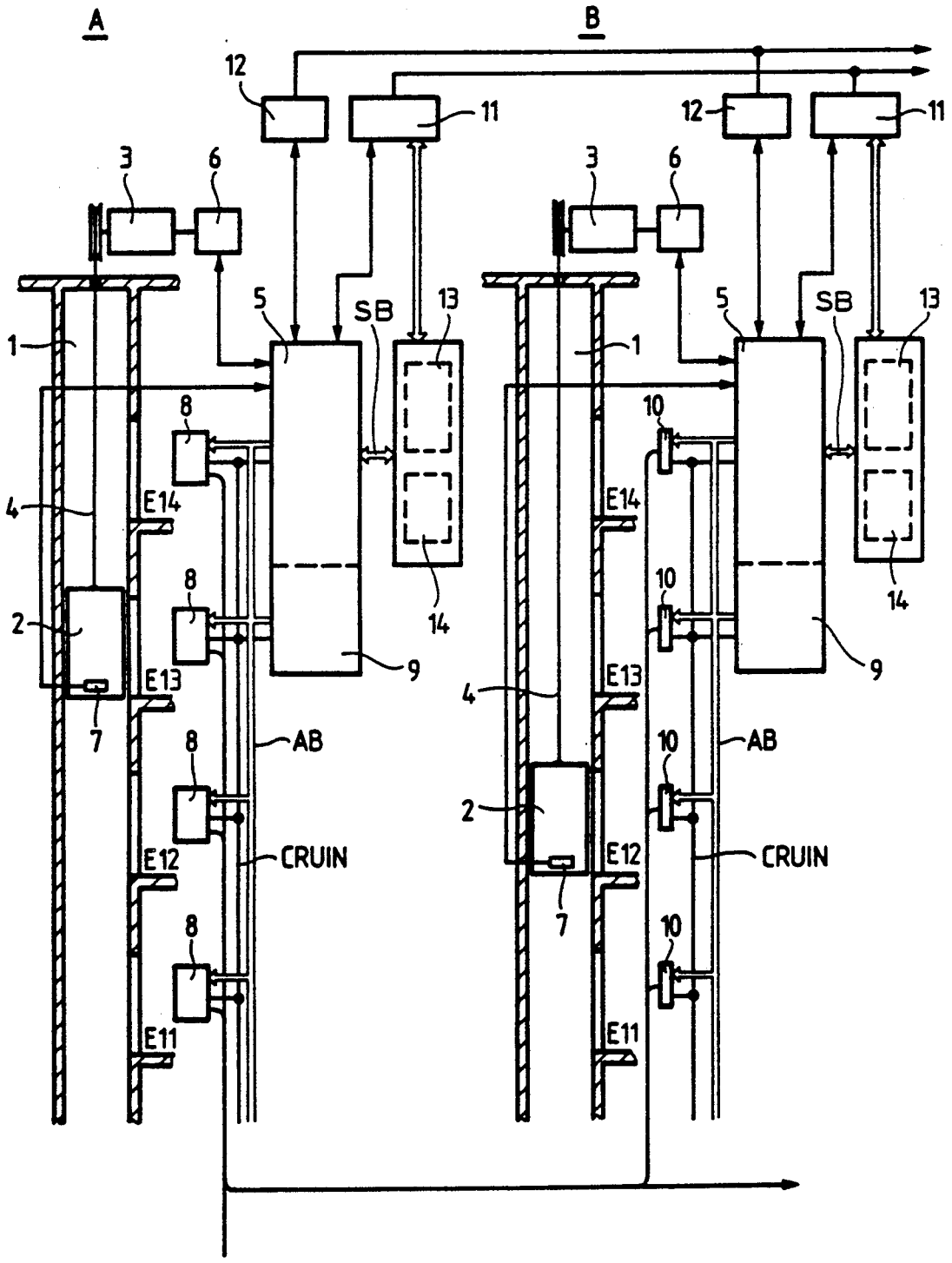
FIG. 1 is a schematic block diagram of an elevator group control according to the present invention for two elevators of an elevator group.

Designated with A and B in FIG. 1 are two elevators of an elevator group, each having an elevator car 2 guided in an elevator shaft 1 and driven by a hoist motor 3 by way of a hoisting cable 4. Each elevator car 2 serves, for example, fifteen floors E0 to E14 with only the top four floors being shown. The hoist motor 3 is controlled by a control system, such as is shown in the European patent no. EP-B 0 026 406, where the generation of the nominal or set point values, the control functions and the stop initiation are realized by means of a microcomputer system 5, which is connected with a control unit 6 of the drive control system. The microcomputer system 5 calculates from elevator parameters a sum corresponding to the average waiting time of all passengers, also termed operating costs, which forms the basis of the call assignment process. The car 2 includes a load measuring device 7, which is likewise connected with the microcomputer system 5, for determining when passengers enter and leave the elevator car.

Provided at the floors are call registering devices 8 which can be in the form of ten key keyboards, as shown in European patent no. 0 246 395, by means of which floor calls for trips to desired floors of destination can be entered. The call registering devices 8 are connected with the microcomputer system 5 and an input device 9, shown in the European patent no. EP-B 0 062 141, by way of an address bus AB and a data input conductor CRUIN. The call registering devices 8 can be assigned to more than one elevator group. For example, those of the elevator A are in connection by way of coupling elements in the form of multiplexers 10 with the microcomputer system 5 and the input device 9 of the elevator B. The microcomputer systems 5 of the individual elevators of the group are connected together by way of a comparison device 11, shown in the European patent no. EP-B 0 050 304, and by way of a party-line transfer system 12, shown in the European patent no. EP-B 0 050 305, and form, together with the call registering devices 8 and the input devices 9, a group control. A load memory 13 for storing load data and a control circuit 14 are connected with a bus SB of the microcomputer system 5 and are explained in more detail below.

Figure 2:
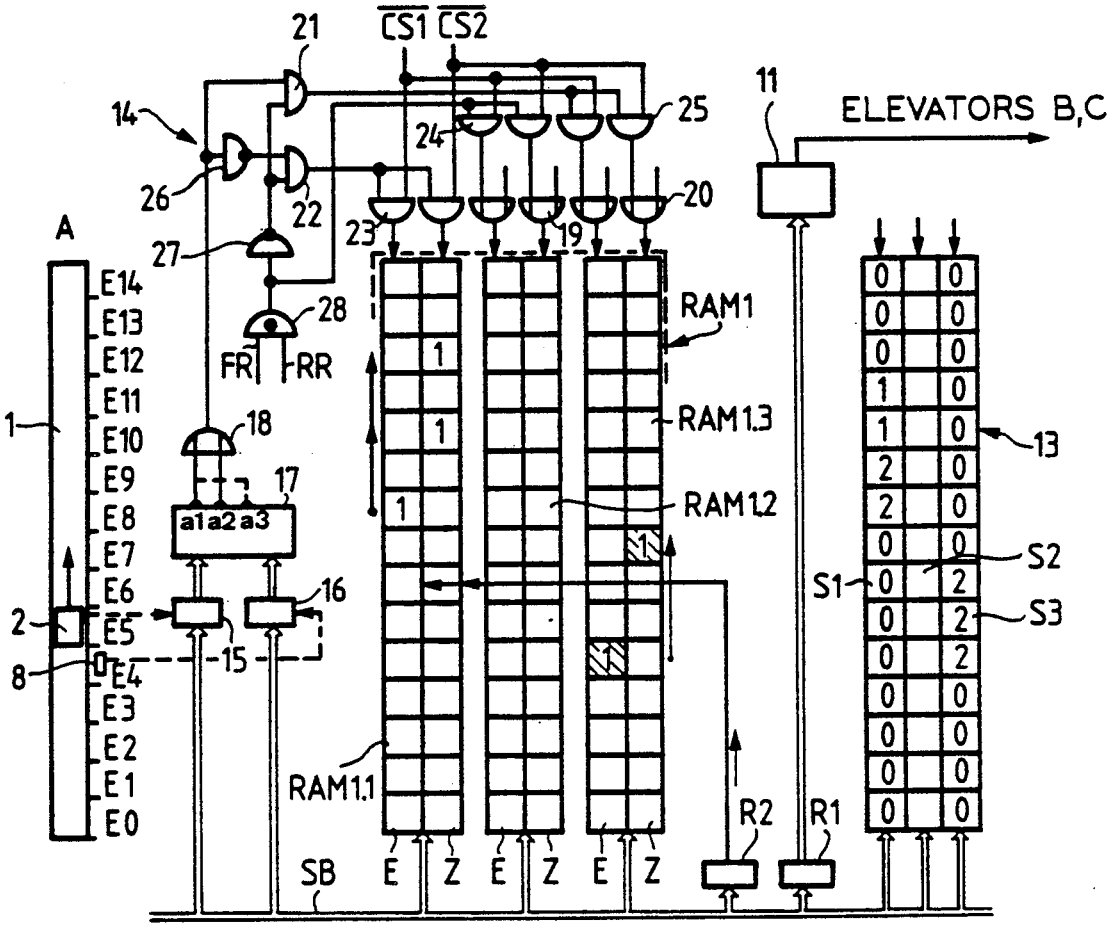
FIG. 2 is a schematic block diagram of a load memory and a control circuit associated with the elevator group control shown in FIG. 1.
Figure 3:
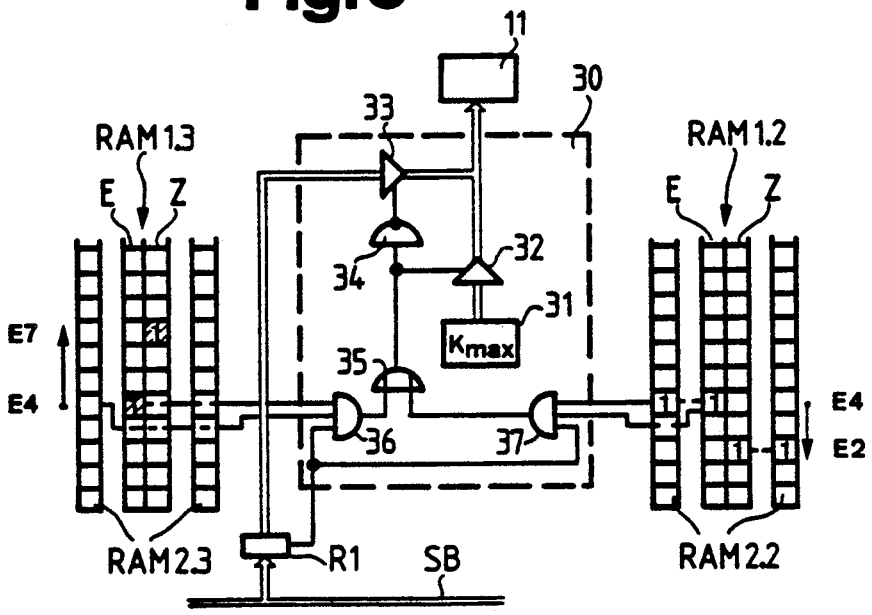
FIG. 3 is a schematic block diagram of a switching circuit associated with the elevator group control shown in FIG. 1.

Illustrated schematically in FIG. 2 is a portion of the microcomputer system 5 which is, for example, associated with the elevator A. A call memory RAM1 includes a first register RAM1.1 for storing calls in the direction of travel and ahead of the car 2 (first portion of a trip), a second register RAM1.2 for storing calls in the direction of travel opposite to the car (second portion of a trip), and a third register RAM1.3 for storing calls in the direction of travel of and behind the car (third portion of a trip). The registers RAM1.1, RAM1.2 and RAM1.3 each are divided into two portions E and Z, which each include a memory storage cell for each floor. The calls identifying the input floors are stored in the portions E and the calls identifying the destination floors are stored in the portions Z. The registers RAM1.1, RAM1.2 and RAM1.3 are associated with call assignment memories (not shown), in which assignment instructions identifying assigned calls are stored, as shown in the European patent no. 0 246 395 for example. A cost register R1, for storing the operating costs, and a selector R2, for forming addresses which correspond to the floor numbers and by means of which the storage spaces of the first register RAM1.1 and of the associated assignment memories can be interrogated, are connected to the bus SB. The first register RAM1.1, the second register RAM1.2 and the third register RAM1.3, as well as the associated assignment memories, are each read-write memories which are connected with the bus SB of the microcomputer system 5. The calls which are stored in the floor call memory RAM1 and the assignment instructions stored in the assignment memories are characterized symbolically by "1". As shown in FIGS. 2 and 3, allocated calls are stored for the floors E8, E10 and E12 and new, not yet allocated calls (hatched fields) are stored for the floors E4 and E7.

As shown in FIG. 2, the load memory 13 includes a readwrite memory in the form of a matrix having as many rows as there are floors and three columns S1, S2 and S3. The first column S1 of the matrix is associated with the calls of the same direction of travel lying ahead of the car 2, the second column S2 is associated with the calls of opposite direction of travel and the third column S3 with the calls of the same direction of travel lying behind the car. In the storage spaces of the memory 13, load values are stored in the form of a number of persons who are located in the car 2 on the departure from or travel past a floor. For example, it is assumed in FIG. 2 that the car 2 is travelling in an upward direction in the region of the floor E5 and upward direction calls were entered at the floors E4 and E8. After the transmission of the calls into the first register RAM1.1 and the third register RAM1.3, a sum is formed from the number of the calls (boarding passengers) entered at a floor and the number of the calls (alighting passengers) designating this floor as a destination and is stored as a load value in the memory 13. The first column S1 and the third column S3 of the memory 13 will therefore, by reason of the chosen number of boarding and alighting passengers, have stored the load values shown in FIG. 2. Thus, the load values two, two, one, one and zero in the first column S1, for example, are generated for the floors E8 through E12 respectively from two boarding passengers at the floor E8 and one alighting passenger each at the floors E10 and E11. During the calculation of the operating costs, the computer 5 can obtain the number of the passengers located in the car 2 for any future stop can ascertain by reference to the stored values whether overload would occur on assignment of a call at a certain floor to the car 2.

As described above, the elevator control according to the present invention draws conclusions concerning the future boarding and alighting passengers and the loads thereby arising in the car 2 from the calls entered in the load memory 13. It is possible, however, that passengers enter their call more than once or that passengers board who have entered no call. In these cases, the stored load values must be corrected. For this purpose, the memory 13 is connected through the microcomputer system 5 with the load measuring device 7 associated with the car 2 (FIG. 1). In the first case, as many of the same destination calls are deleted at the floor concerned as correspond to the difference between the stored value and the actually measured car load. Thereafter, all stored load values between the boarding floor and the destination floor of the call entered more than once are corrected. In the second case, the stored load values must be increased, for which it is presumed that the passenger, who has entered no call, wants to travel to a destination which is identified by a call already entered by another passenger. If several calls have been entered, it is assumed that the passenger wants to travel to the remotest floor.

The control circuit 14 includes a car position register 15, a car call register 16, a comparator 17, a first OR gate 18, two second OR gates 19, two third OR gates 20, a first AND gate 21, a second AND gate 22, two third AND gates 23, two fourth AND gates 24, two fifth AND gates 25, a first NOT gate 26, a second NOT gate 27, and an EXOR gate 28. Inputs to the comparator 17 are connected to outputs of the car position register 15 and the car call register 16 both of which have inputs connected to the bus SB. A first and a second output, al and a2 respectively, of the comparator 17 are connected to inputs of the first OR gate 18. The first output al is allocated to the relationship "position > call" and the second output a2 is allocated to the relationship "position = call" in the upward direction of travel. The comparator 17 can be formed by the microprocessor of the microcomputer system 5, wherein a third output a3, allocated to the relationship "position < call" on a change in direction of travel is connected in place of the first output al with the one input of the first OR gate 18 (dashed line).

The output of the first OR gate 18 is connected with an input of the first AND gate 21 and an input of the NOT gate 26. The other input of the AND gate 21 is connected to an output of the second NOT gate 27 which has its input connected to an output of the EXOR gate 28. An output of the first NOT gate 26 is connected to one input of the second AND gate 22 which has its other input connected to the output of the second NOT gate 27. An output of the second AND gate 22 is connected to one input of each of the third AND gates 23. One input of each of the fourth AND gates 24 is connected to the output of the EXOR gate 28 and one input of each of the fifth AND gates 25 is connected to the output of the first AND gate 21. A pair of inputs to the EXOR member 28 are connected to a line carrying a travel direction signal FR and to a line carrying a call direction signal RR. An output of each of the fourth AND gates 24 is connected to an input of an associated one of the second OR gates 19 and an output of each of the fifth AND gates 25 is connected to an input of an associated one of the third OR gates 20.

Address decoders (not shown) generate a circuit block release signal $\overline{CS1}$ on a line connected to another input of each of the third AND gate 23 having an output connected to the E portion of the first register RAM1.1, the fourth AND gate 24 connected to the second OR gate 19 having an output connected to the E portion of the second register RAM1.2, and the fifth AND gate 25 connected to the third OR gate 23 having an output connected to the E portion of the third register RAM1.3. The address decoders (not shown) also generate a circuit block release signal $\overline{CS2}$ on a line connected to another input of each of the third AND gate 23 having an output connected to the Z portion of the first register RAM1.1, the fourth AND gate 24 connected to the second OR gate 19 having an output connected to the Z portion of the second register RAM1.2, and the fifth AND gate 25 connected to the third OR 20 gate having an output connected to the Z portion of the third register RAM1.3. The outputs of the third AND gates 23, the second OR gates 19 and the third OR gates 20 are connected to enable inputs of the E and Z portion of the registers RAM1.1 through RAM1.3. The other inputs of the second and third OR gates 19 and 20 are connected to the address decoders (not shown) for receiving additional circuit block signals. The control circuit 14 is activated each time the car position and the call address, corresponding to the floor number, of a new call are entered into the registers 15 and 16. The control circuit has the task, through generation of a signal dependent on car position, position and direction of the call, as well as the direction of travel, to control the entry of the destination calls into the first register RAM1.1, the second register RAM1.2 or the third register RAM1.3 as well as to enable access to the associated columns S1, S2 and S3 of the load data storage device 13.

As shown in FIG. 3, an associated assignment memory RAM2.2 is provided for the memory portions E and Z of the second register RAM1.2 and an associated assignment memory RAM2.3 is provided for the memory portions E and Z of the third register RAM1.3. A switching circuit 30 suppresses the assignment of a new call when a call of opposite direction at the same input floor has already been allocated to the elevator concerned. In this manner, transportation of the boarding passengers of the new call in the wrong direction can be avoided. The switching circuit 30 includes a register 31 containing a maximum value $K_{max}$ of the operating costs, first and second tristate buffers 32 and 33, a NOT gate 34, an OR gate 35 and first and second AND gates 36 and 37.

The first AND gate 36 has one input connected to an output of the storage cells of the memory portion E of the third register RAM1.3, a second input connected to an output of the storage cells of the associated assignment memory RAM2.3, and a third input connected to the output of the cost register R1. Similarly, the second AND gate 37 has one input connected to an output of the storage cells of the memory portion E of the second register RAM1.2, a second input connected to an output of the storage cells of the associated assignment memory RAM2.2 and a third input connected to the output of the cost register R1. An output of each of the AND gates 36 and 37 is connected to one of the inputs of the OR gate 35, an output of which is connected to the enable input of the first tristate buffer 32 and through the NOT gate 34 with the enable input of the second tristate buffer 33. An input of the buffer 32 is connected to an output of the register 31, an input of the buffer 33 is connected to an output of the cost register R1 and outputs of both buffers are connected to data inputs of the comparison device 11. The switching circuit 30, which can be formed by a program of the microcomputer system 5, is activated each time the operating costs are transferred into the cost register R1 for the floor concerned.

The above described group elevator control operates as follows: Let it be assumed according to the example of FIG. 2 that a call for the floor E7 was entered at the floor E4 and the car 2 of the elevator A is travelling upwardly in the region of the floor E5 in order to serve the allocated calls for the floors E8, E10 and E12. Upon scanning of the call registering devices 8 (FIG. 1) for newly entered calls, the car position is read first and transferred into the car position register 15. In order to format the car position in binary coded form, equipment shown in West German patent no. DE 28 32 973 can be used, for example. After finding the call identifying the entry floor E4, the address thereof is transferred into the call registers 16 of all the elevators. The call direction signal, the travel direction signal and, when the condition "position > call" is fulfilled, also the output al of the comparator 17 can be logic "1. The call identifying the input floor E4 is therefore entered only into the memory portion E of the third register RAM1.3 through the first AND gate 21 because the second AND gate 22 is blocked by the first NOT gate 26, and the call identifying the destination floor E7 is entered into the memory portion Z of the third register RAM1.3 upon the occurrence of CS2 = "1".

It is assumed in this case that the new call is allocated to the third portion of the trip also for the other elevators and is thus likewise entered into their third registers RAM1.3. After the entry of the new call pair E4/E7, the load memories 13 of all of the elevators are connected, wherein the processor of the microcomputer system 5 interprets the logic state "1" at the output of the first AND gate 21 in such a manner that the new call pair is allocated to the third column S3 and the corresponding circuit block release signal must be set to "1" on the correction of the load values. Thereafter, both the comparator outputs a1 and a2 are set to logic "0" through suitable loading of the registers 15 and 16 so that the blocking of the second AND gate 22 is cancelled. Thereby, free access to the first register RAM1.1, which is required for the following calculation of the operating costs, is assured by means of the signals CS1 = "1" and CS2 = "1". By generating the associated circuit block release signals to the other inputs of the second and third OR gates 19 and 20, the second and third registers RAM1.2 and RAM1.3 can in this case also be freed for the calculation. Immediately after the calculation, which can for example take place according to a similar relationship as is shown in the European patent no. EP-A-0 246 395, the operating costs are transferred into the cost register R1 and compared by means of the comparison device 11, for example according to teachings of European patent no. EP-B-0 050 304, with the operating costs of the other elevators.

Let it be assumed that elevator A has the smallest operating costs so that assignment instructions are written into the associated assignment memory, not shown in the FIG. 2, at the floors E4 and E7 and the assignment is final. If the selector R2 now in continuation of the assumed upward travel switches to the floor E7, then the newly assigned call is ignored, since only the first register RAM1.1 is enabled each time for scanning by the selector R2 when CS1 = "1" and CS2 = "1". After serving the calls for the floors E8, E10 and E12, the travel direction signal on the line FR changes with the direction of travel of the car 2, whereby a computer subroutine is initiated for the transfer of the allocated calls from the second register RAM1.2 into the first register RAM1.1 and from the third register RAM1.3 into the second register RAM1.2. The car 2 could therefore, after completion of the downward travel (second portion of the trip) and a thereby once again initiated transfer of the calls from the second register RAM1.2 into the first register RAM1.1, serve the calls of the floors E4 and E7 during the subsequent upward travel (third portion of the trip).

Upon the entry of a call of opposite direction, the first and second AND gates 21 and 22 are blocked by the input signals "1" and "0" from the EXOR gate 28 and the fourth AND gates 24 are enabled so that the call of opposite direction can be written into the second register RAM1.2 with CS1 = "1" and CS2 = "1".

If in the case of the input floor E4 of the new call assumed according to the example of FIG. 2, there is also an input floor of an already allocated call of opposite direction for the floor E2, for example, then the output of the second AND gate 37 of the switching circuit 30 (FIG. 3) is set high on the transfer of the operating costs into the cost register R1 so that the first tristate buffer 32 is enabled and the second tristate buffer 33 is blocked. Thereby, the operating costs stored in the cost register R1 are blocked and the maximum value $K_{max}$ contained in the register 31 is fed to the comparison device 11 so that the new call from the floor E4 to the floor E7 cannot be assigned to the elevator A in this situation.

After the assignment of the call, as initially assumed, to the elevator A, the cost registers R1 of all the elevators are erased and are ready for the reception of the operating costs of a further new call. If it is ascertained during the assignment process of a new call from the same floor that the elevator A does not have the smallest operating costs, the assignment instructions written into the associated assignment memory of the elevator A will not be cancelled, which can for example be achieved by means of an elevator control shown in European patent application no. EP-PA 88110006.9.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In a group control for elevators having at least two elevator cars for serving a plurality of floors and for the immediate assignment of floor calls of destination including call registering devices located at the floors for entering calls for desired floors of destination, a call memory for each elevator of the group connected with the call registering devices, wherein on the input of call at a floor, a call identifying the input floor and a call identifying the destination floor are stored in the call memories, load measuring devices provided in the cars of the elevator group and connected with a load memory in which load values corresponding to the persons present in the car at a future stop are stored, a selector associated with each elevator of the group and indicating the floor of a possible stop, and means for assigning the entered calls to the cars of the elevator group immediately after the calls are entered having for each car a computer and a comparison device, the computer calculating operating costs corresponding to the waiting times of passengers from data specific to the associated elevator, the comparator comparing the operating costs of all of the elevators one with the other, and the computer assigning the call concerned to that car which displays the lowest operating costs through entry of an assignment instruction into an associated assignment memory, the improvement comprising:

the call memory for each elevator car including a first register for storing calls of like direction of travel entered ahead of the car, a second register for storing calls of opposite direction of travel and a third register for storing calls of like direction of travel entered behind the car, and the selector being connected only with said first register and the associated assignment memory;

the load memory for each elevator car including at least two columns of memory cells wherein the load values resulting from the calls entered ahead of the car in the like direction of travel are stored in the memory cells of one of said columns and the load values v resulting from the calls entered behind the car in the like direction of travel are stored in the memory cells of the other column; and a control circuit for each elevator car connected with the call memory and the load memory associated with the car and activated by each entry of a call such that a call in the same direction of travel as the car is according to its position with respect to the car written into one of said first and third registers and access to the associated one of said columns is enabled, said control circuit transferring the calls of said third register into said second register on a first change in direction of travel of the car and into said first register on a second change in direction of travel of the car.

2. The improvement according to claim 1 wherein said first, second and third registers each include two separate memory portions, the calls identifying the input floors being stored in one said memory portion and the calls identifying the destination floors being stored in the other one of said memory portions.

3. The improvement according to claim 2 wherein said control circuit includes a car position register, a call register, a comparator, a first, two second and two third OR gates each having two inputs, a first, a second, two third, two fourth and two fifth AND gates each having two inputs, a first and a second NOT gate and an EXOR gate; said comparator having inputs connected to outputs of said car position register and said call register and a first and a second output connected to the inputs of said first OR gate; an output of said first OR gate being connected with one input of said first AND gate and an input of said first NOT gate; an output of said first Not gate being connected to one input of said second AND gate; an output of said EXOR gate being connected through said second Not gate to the other inputs of said first and second AND gates; an output of said second NOT gate is connected with one input of each of the third AND gates; one input of each of said fourth AND gates is connected with the output of said EXOR gate; one input of each of the fifth AND gates is connected with an output of said first AND gate; a pair of inputs to said EXOR gate are connected to a line carrying a travel direction signal and a line carrying a call direction signal; the other inputs of said third, fourth and fifth AND gates are connected to a source of circuit block release signals; an output of one each of said third, fourth and fifth AND gates being connected to said one memory portion of said first, second and third registers respectively and an output of the other one of said third, fourth and fifth AND gates being connected to said other memory portion of said first, second and third registers respectively; and the outputs of said fourth AND gates being connected to one input of said second OR gates each having an output connected to said second register and the outputs of said fifth AND gates being connected to one input of said third OR gates each having an output connected to said third register.

4. A group control for elevators having at least two elevator cars for serving a plurality of floors comprising:

call registering devices located at the floors for entering floor calls for desired floors of destination;

a call memory for each elevator of the group connected with said call registering devices, wherein on the input of a call at a floor, a call identifying the input floor and a call identifying the destination floor are stored in said call memories;

load measuring devices provided in the cars of the elevator group and connected with a load memory in which load values corresponding to the persons present in the car at a future stop are stored;

a selector associated with each elevator of the group and indicating the floor of a possible stop;

means for assigning the entered calls to the cars of the elevator group immediately after the calls are entered having for each car a computer and a comparison device, the computer calculating operating costs corresponding to the waiting times of passengers from data specific to the associated elevator, the comparator comparing the operating costs of all of the elevators one with the other, and the computer assigning the call concerned to that car which displays the lowest operating costs through entry of an assignment instruction into an associated assignment memory;

the call memory for each elevator car including a first register for storing calls of like direction of travel entered ahead of the car, a second register for storing calls of opposite direction of travel and a third register for storing calls of like direction of travel entered behind the car, and the selector being connected only with said first register and the associated assignment memory;

the load memory for each elevator car including at least two columns of memory cells wherein the load values resulting from the calls entered ahead of the car in the like direction of travel are stored in the memory cells of one of said columns and the load values resulting from the calls entered behind the car in the like direction of travel are stored in the memory cells of the other column; and a control circuit for each elevator car connected with said call memory and said load memory associated with the car and activated by each entry of a call such that a call in the same direction of travel as the car is according to its position with respect to the car written into one of said first and third registers and access to the associated one of said columns is enabled, said control circuit transferring the calls of said third register into said second register on a first change in direction of travel of the car and into said first register on a second change in direction of travel of the car.

5. The group control according to claim 4 wherein said first, second and third registers each include two separate memory portions, the calls identifying the input floors being stored in one said memory portion and the calls identifying the destination floors being stored in the other one of said memory portions.

6. The group control according to claim 4 wherein said control circuit said control circuit transfers the calls of said third register into said second register and the calls of said second register into said first register on a first change in direction of travel of the car and said calls of said second register into said first register on a second change in direction of travel of the car.

7. In a group control for elevators having at least two elevator cars for serving a plurality of floors and for the immediate assignment of floor calls of destination entering calls for desired floors of destination, a call memory for each elevator of the group connected with the call registering devices, wherein on the input of call at a floor, a call identifying the input floor and a call identifying the destination floor are stored in the call memories, load measuring devices provided in the cars of the elevator group and connected with a load memory in which load values corresponding to the persons present in the car at a future stop are stored, a selector associated with each elevator of the group and indicating the floor of a possible stop, and means for assigning the entered calls to the cars of the elevator group immediately after the calls are entered having for each car a computer and a comparison device, the computer calculating operating costs corresponding to the waiting times of passengers from data specific to the associated elevator, the comparator comparing the operating costs of all of the elevators one with the other, and the computer assigning the call concerned to that car which displays the lowest operating costs through entry of an assignment instruction into an associated assignment memory, the improvement comprising:

the call memory for each elevator car including a first register for storing calls of like direction of travel entered ahead of the car, a second register for storing calls of opposite direction of travel and a third register for storing calls of like direction of travel entered behind the car, and the selector being connected only with said first register and the associated assignment memory;

the load memory for each elevator car including at least two columns of memory cells wherein the load values resulting from the calls entered ahead of the car in the like direction of travel are stored in the memory cells of one of said columns and the load values resulting from the calls entered behind the car in the like direction of travel are stored in the memory cells of the other column; and a control circuit for each elevator car connected with the call memory and the load memory associated with the car and having a comparator connected to a car position register and a call register and activated by each entry of a call such that a call in the same direction of travel as the car is according to its position with respect to the car written into one of said first and third registers and access to the associated one of columns is enabled, said control circuit transferring the calls of said third register into said second register on a first change in direction of travel of the car and into said first register on a second change in direction of travel of the car.

8. The improvement according to claim 7 wherein said first, second and third registers each include two separate memory portions, the calls identifying the input floors being stored in one said memory portion and the calls identifying the destination floors being stored in the other one of said memory portions.

* * * * *